US005642647A

United States Patent [19]

Peruski

[11] Patent Number: 5,642,647

[45] Date of Patent: Jul. 1, 1997

[54] BOLT AND NUT HOLDER

[76] Inventor: Robert Peruski, 6686 Orchard Lake Rd., West Bloomfield, Mich. 48322

[21] Appl. No.: 581,438

[22] Filed: Dec. 29, 1995

[51] Int. Cl.[6] ..... B25B 9/00

[52] U.S. Cl. ..... 81/13; 81/64; 81/125

[58] Field of Search ..... 81/13, 125, 487, 81/55, 44, 488, 64, 451, 452

[56] References Cited

U.S. PATENT DOCUMENTS 3,507,172 4/1970 Smith .
4,631,985 12/1986 Roberts .
4,984,503 1/1991 Farnsworth .

*Primary Examiner*—Bruce M. Kisliuk
*Assistant Examiner*—Joni B. Danganan
*Attorney, Agent, or Firm*—Alex Rhodes

[57] ABSTRACT

A tool for engaging a bolt or nut in confined and obstructed locations. In a first aspect of the invention the tool has an elongated body having a straight portion and an adjoining loop-shaped end portion. A plurality of thin resilient wires are arranged around the loop-shaped end portion and are joined to the loop-shaped end portion with a wire which is tightly coiled around the loop-shaped end portion. A thin plate is joined to the loop-shaped end portion to form a pocket for receiving a bolt or a nut. In the second aspect of the invention, a slender elongated wire body has a straight portion and opposite alternate size loop-shaped end portions. A plurality of thin wires are joined to the body's loop-shaped end portions and extend inwardly toward the centers of the loop-shaped end portions.

11 Claims, 3 Drawing Sheets

BOLT AND NUT HOLDER

BACKGROUND OF THE INVENTION

This invention relates to holding devices for threaded fasteners and more particularly to an easy to use device for engaging a variety of bolts and nuts in confined and obstructed locations.

Fasteners, such as bolts and nuts, are often difficult or impossible to engage by hand in confined and obstructed locations. Consequently, they are frequently lost or require excessive time to install. Of the numerous tools for engaging bolts and nuts which exist in the art, some are complex; others prematurely disengage; and others do not adequately hold bolts and nuts during engagements with complementary members.

Smith U.S. Pat. No. 3,507,172; Roberts U.S. Pat. No. 4,631,985; and Farnsworth U.S. Pat. No. 4,984,503; are exemplary of bolt and nut holders in the prior art. Smith discloses a tool for installing nuts and bolts having a flexible wire frame with a hexagonal end portion for holding the head of a bolt or a nut. The hexagonal end portion is adapted to hold only one size of a bolt or nut, separate tools being required for each size of bolt or nut. Moreover, the holder easily disengages from the bolt or nut.

Farnsworth discloses a wrench for a one hand tightening of a fastener. Separate wrenches are required for different size bolts and nuts. Farnsworth is not suitable for engaging bolts or nuts in cramped or crowded locations. Farnsworth consists of a large circular plate with plural hex shaped openings and a resilient strip for retaining bolt heads or nuts in the openings of the plate. A handle is not provided for suspending a bolt or nut in a cramped or crowded location.

Roberts discloses a tool having inward projecting resilient planar elements for gripping a body of a screw. Roberts is not suitable for holding nuts.

SUMMARY OF THE INVENTION

The present invention is an effective and easy to use tool for engaging a variety of bolts and nuts. One benefit of the invention is that the same tool can be used with a variety of bolts and nuts. Another benefit is that the time is reduced for installing bolts and nuts at confined locations.

In the first aspect of the invention, the tool comprises a slender wire body having a straight portion and an adjoining end portion formed into a loop. A thin wire is coiled around the body's loop-shaped portion to retain a plurality of thin wires to the loop end portion. The wires are spaced radially around the loop end portion and a plate extends across and is fixed to one side of the loop end portion. A handle is attached to the other end portion of the slender wire body.

In the second aspect of the invention, a thin wire body has opposite loop-shaped end portions. Wires are coiled around each of the body's loop-shaped end portions to retain a plurality of thin wires to the loop end portions. The thin wires are spaced radially around the loop end portions and a plate extends across one side of each loop end portion.

Further features, benefits and objects will be apparent from the ensuing description and accompanying drawing which discloses the invention in detail. The subject matter in which exclusive rights are claimed is set forth in the numbered claims which follow the detailed description.

BRIEF DESCRIPTION OF THE DRAWINGS

The invention will be better understood and further objects, characteristic features, details and advantages thereof will appear more clearly with reference to the diagrammatic drawings illustrating a presently preferred specific embodiment of the invention by way of non-limiting example only.

DETAILED DESCRIPTION OF THE PREFERRED EMBODIMENT

Figure 1:
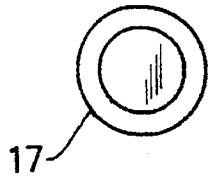
FIG. 1 is a plan view of a single ended tool for engaging a bolt and nut and a hexagonal nut.
Figure 4:
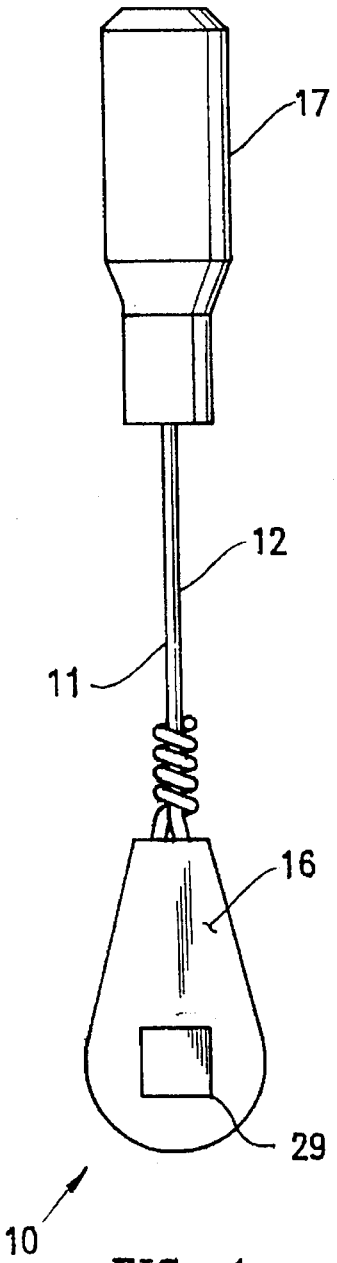
FIG. 4 is a rear view of the tool.

Referring now to the drawings wherein like numerals designate like and corresponding parts, in FIGS. 1–4, inclusive, the numeral 10 generally designates a bolt and nut holder according to the present invention.

The tool 10 is comprised of a slender elongated metal wire body 11 having a straight portion 12 and a slender loop-shaped end portion 13. A metal wire 14 is tightly coiled around end portions of a plurality of thin wires 15 to retain the wires 15 to the loop-shaped end portion 13. The plurality of thin resilient wires 15 are arranged radially around the loop-shaped end portion 13 and extend inwardly. A thin plate 16 is attached and extends across one side of the loop-shaped portion 13 to form a pocket 19 for receiving a bolt or a nut 18. A handle 17 is attached to an opposite end of the straight end portion 12 of the wire body 11.

The plurality of thin wires 15 resemble the bristles of a brush and are preferably made of a resilient plastic, such as nylon or polypropylene or of a metal such as spring steel or spring brass. The wires 15 are preferably assembled to the wire body 11 and the retainer 14 coiled around an end portion of the body 11 before forming the loop end portion 13.

After the wires 15 are joined to the body 11, the end portion of the body 11 is formed into a loop 13. The retaining plate 16 is thereafter resistant welded or otherwise suitably attached to the loop end portion 13 to form the pocket 19 for receiving the nut 18 or a bolt (not shown). On the outer surface of the retaining plate, a bar magnet 29 is joined to the plate. The bar magnet is an optional feature of the invention.

Figure 3:
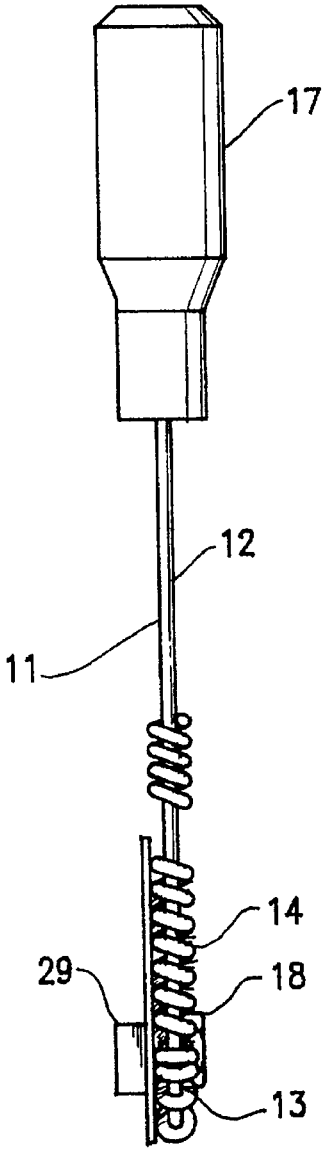
FIG. 3 is a right side view of the tool.
Figure 2:
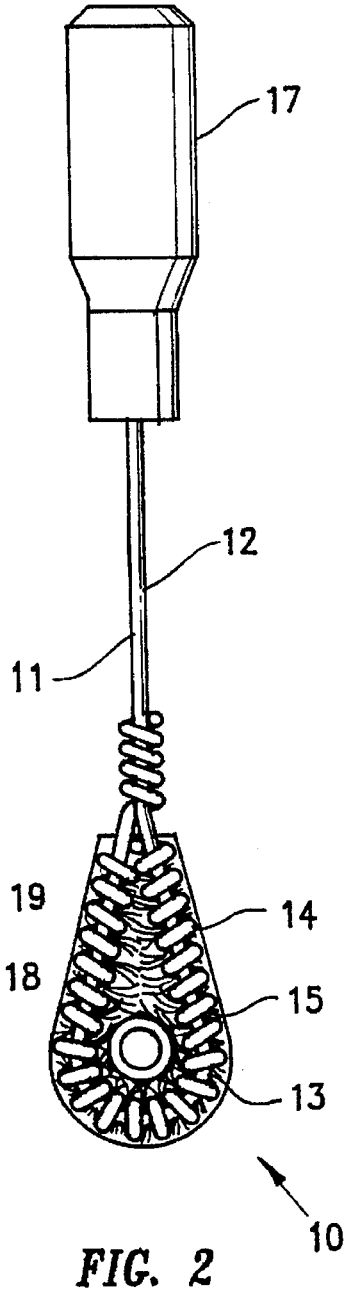
FIG. 2 is a front view of the tool.

The manner of using the invention is shown in FIGS. 2 and 3 wherein the nut 18 is held in the pocket 19 by the inward extending thin wires 15. The inner end portions of the wires 15 deflect to retain the nut 18. As will be observed, the resilient wires 15 permit the tool 10 to be used for holding different size and shape fasteners, including bolts with hexagonal, square and round heads.

Moreover, it will be appreciated that the loop end portion 13 may be circular as shown in the drawings, or otherwise shaped, it not being my intention to limit my invention to a circular shape.

Figure 7:
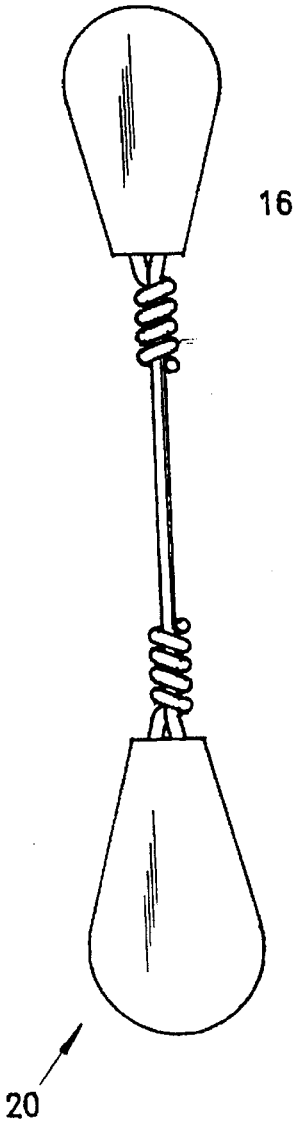
FIG. 7 is a rear view of the alternate embodiment.
Figure 6:
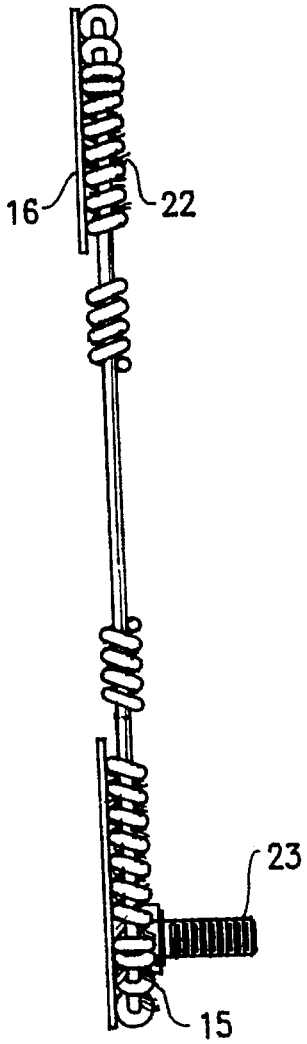
FIG. 6 is a right side view of the alternate embodiment.
Figure 5:
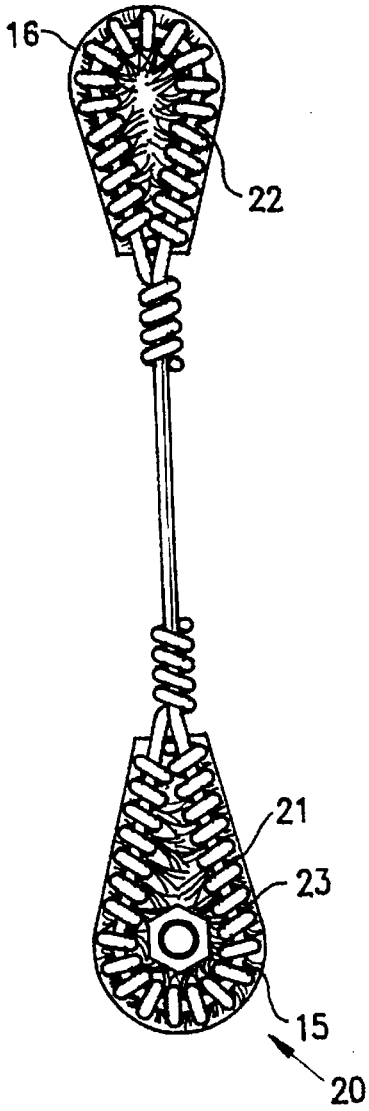
FIG. 5 is a front view of an alternate embodiment showing a double ended tool wherein the ends of the tool are of different sizes and a bolt.

In FIGS. 5 to 7 an alternate embodiment 20 is illustrated, having alternate different size loop-shaped end portions 21, 22. Both loop-shaped end portions 21, 22 lie in the same plane. The head portion of a bolt 23 is shown held in one of the loop-shaped end portions 21. One benefit of the second embodiment 20 is that it accommodates a larger range of fastener sizes than the first embodiment 10.

Figure 9:
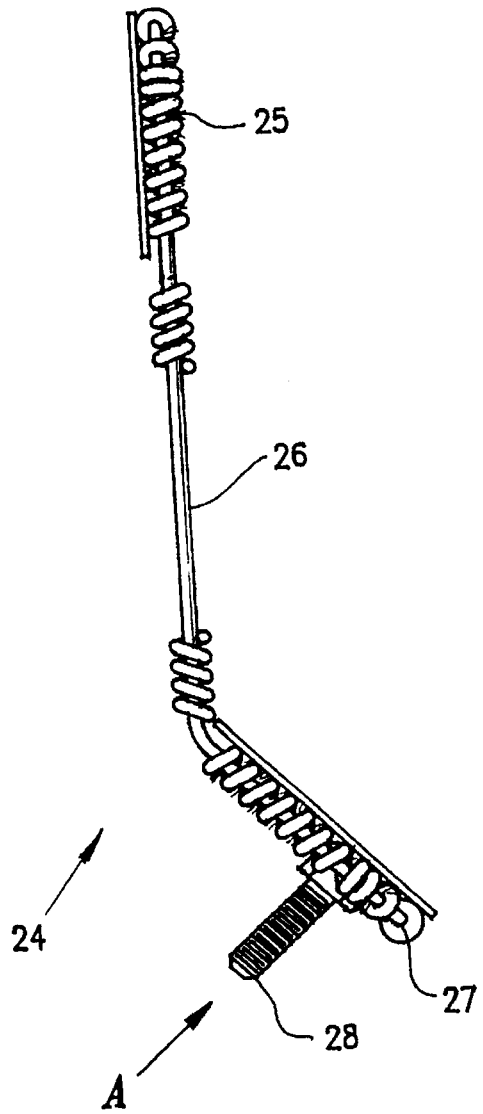
FIG. 9 is a right side view of the second alternate embodiment.
Figure 8:
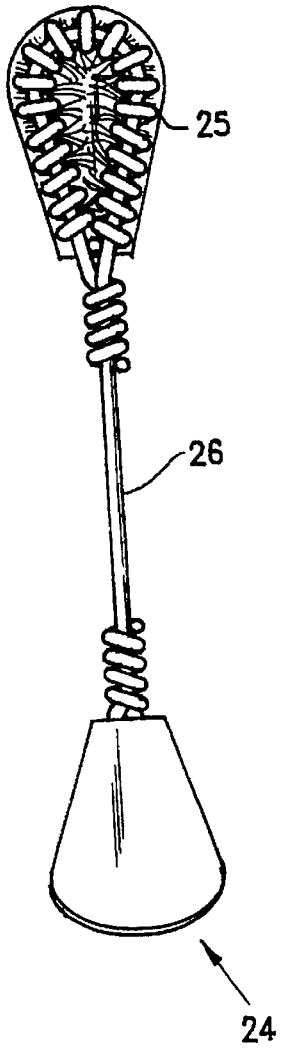
FIG. 8 is a front view of a second alternate embodiment showing a double ended tool wherein the ends of the tool are of different sizes and one end is angled and a bolt.
Figure 10:
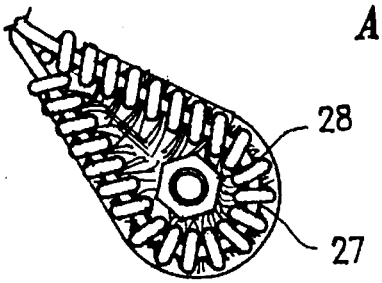
FIG. 10 is a partial auxiliary view taken in the direction of arrow "A" in FIG. 9.

In FIGS. 8 through 10, a third embodiment 24 is illustrated having one loop-shaped end portion 25 which is aligned with a straight body portion 26 and an opposite different size loop-shaped end portion 27 which is at an angle with the adjoining straight body portion 26. A bolt 28 is shown retained in the angular loop-shaped end portion 27.

From the foregoing it will be apparent that my invention provides an effective, easy to use, low cost tool for engaging bolts and nuts. It will be further apparent that my tool can be constructed to engage other items such as tapered pins, clips and the like.

Although but several embodiments have been described, it will be appreciated that other embodiments can be provided by changes in shape, material, arrangement and substitution of parts without departing from the spirit thereof.

I claim:

1. A tool for engaging a variety of bolts and nuts comprising a slender elongated body, said body having a straight portion and at least one adjoining loop-shaped end portion; a plurality of thin resilient wires arranged radially around the loop-shaped end portion and having end portions attached to the loop-shaped end portion, said thin wires extending inwardly toward the center of said loop-shaped end portion; and a wire for retaining said thin inward extending wires to said loop-shaped end portion, said wire being coiled tightly around said end portions of said thin wires and said body's loop-shaped end portion.

2. The tool recited in claim 1 further comprising a plate extending across one side of said loop-shaped end portion, said plate being attached to said loop-shaped end portion for forming a pocket.

3. The tool recited in claim 2 further comprising a permanent magnet attached to an outer surface of said plate.

4. The tool recited in claim 1 wherein said loop-shaped end portion tapers from an arcuate shaped outer portion to an adjoining straight body portion.

5. The tool recited in claim 1 further comprising a handle attached to an end portion of said body which is opposite said loop-shaped end portion.

6. The tool recited in claim 1 further comprising a second loop-shaped end portion of said body opposite said loop-shaped end portion; a plurality of resilient thin wire-like elements positioned around said second loop-shaped end portion attached to said second loop-shaped end portion and extending inwardly toward the center of said second loop-shaped end portion; and a wire for retaining said thin inward extending wires to said second loop-shaped end portion, said wire being coiled tightly around said end portions of said inward extending wires and said second loop-shaped end portion of said body.

7. The tool recited in claim 6 wherein said second loop-shaped end portion is arranged at an angle with respect to said straight portion of said body.

8. A tool for engaging a variety of bolts and nuts comprising a slender elongated wire body, said body having at least one adjoining loop-shaped end portion; a plurality of thin resilient wires arranged around and extending inwardly from said loop-shaped end portion; and a means for retaining said inward extending wires to said loop-shaped end portion.

9. A tool for engaging a variety of bolts and nuts comprising a slender elongated body, said body having a straight portion, an adjoining first loop-shaped end portion and a second adjoining smaller loop-shaped opposite end portion; each of said loop-shaped end portions having a plurality of thin resilient wires arranged around said loop-shaped end portion, said resilient inward extending wires attached to said loop-shaped end portion.

10. The tool recited in claim 9 wherein each of said loop-shaped end portions lie in the same plane.

11. The tool recited in claim 9 wherein one of said loop-shaped end portion lies in the same plane as said straight portion and the other of said loop-shaped portion is arranged at an angle with respect to said other loop-shaped end portions.

* * * * *